US008548718B2

(12) United States Patent
Kato et al.

(10) Patent No.: US 8,548,718 B2
(45) Date of Patent: Oct. 1, 2013

(54) AIR/FUEL RATIO VARIATION ABNORMALITY DETECTION APPARATUS, AND ABNORMALITY DETECTION METHOD

(75) Inventors: Toshihiro Kato, Toyota (JP); Isao Nakajima, Toyota (JP); Yoshihisa Oda, Toyota (JP); Takefumi Uchida, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/455,812

(22) Filed: Apr. 25, 2012

(65) Prior Publication Data

US 2012/0277979 A1 Nov. 1, 2012

(30) Foreign Application Priority Data

Apr. 28, 2011 (JP) ..... 2011-101687

(51) Int. Cl.
*F02D 41/22* (2006.01)

(52) U.S. Cl.
USPC ..... 701/107; 123/479; 73/114.45

(58) Field of Classification Search
USPC ..... 701/103–105, 107; 123/299, 300, 123/479, 198 D; 73/114.38, 114.45
See application file for complete search history.

(56) References Cited

U.S. PATENT DOCUMENTS

| | | | | |
|---|---|---|---|---|
| 6,564,616 | B2 * | 5/2003 | Antonioli et al. | 73/49.7 |
| 2008/0312806 | A1 | 12/2008 | Ueda | |
| 2009/0211350 | A1 | 8/2009 | Iwazaki et al. | |
| 2009/0260347 | A1 | 10/2009 | Iwazaki et al. | |
| 2010/0168986 | A1 | 7/2010 | Iwazaki et al. | |
| 2010/0211290 | A1 | 8/2010 | Kidokoro et al. | |
| 2012/0022772 | A1 * | 1/2012 | Miyamoto et al. | 701/104 |

FOREIGN PATENT DOCUMENTS

| | | | |
|---|---|---|---|
| JP | 2006-017006 | A | 1/2006 |
| JP | 2006-291876 | A | 10/2006 |
| JP | 2007-023960 | A | 2/2007 |
| JP | 2008-309065 | A | 12/2008 |
| JP | 2009-030455 | A | 2/2009 |
| JP | 2009-180171 | A | 8/2009 |
| JP | 2009-203881 | A | 9/2009 |
| JP | 2009-257236 | A | 11/2009 |
| JP | 2009-264184 | A | 11/2009 |
| JP | 2009-287544 | A | 12/2009 |
| JP | 2010-190089 | A | 9/2010 |
| JP | 2010-532443 | A | 10/2010 |

* cited by examiner

*Primary Examiner* — Hai Huynh
(74) *Attorney, Agent, or Firm* — Gifford, Krass, Sprinkle, Anderson & Citkowski, P.C.

(57) ABSTRACT

In an abnormality detection apparatus and an abnormality detection method for a construction in which each of cylinders is provided with a plurality of fuel injection valves, if it is discerned that a cause of the inter-cylinder variation abnormality exists in one of the fuel injection valves, an air/fuel ratio fluctuation parameter as an index value that represents the degree of the abnormality is calculated by normalizing the air/fuel ratio fluctuation parameter regarding that fuel injection valve on the basis of the injection proportion used when the parameter is measured.

4 Claims, 10 Drawing Sheets

AIR/FUEL RATIO VARIATION ABNORMALITY DETECTION APPARATUS, AND ABNORMALITY DETECTION METHOD

CROSS REFERENCE TO RELATED APPLICATIONS

This application claims priority to Japanese Patent Application No. 2011-101687 filed on Apr. 28, 2011, which is incorporated herein by reference in its entirety including the specification, drawings and abstract.

BACKGROUND OF THE INVENTION

1. Field of the Invention

The invention relates to an apparatus for detecting an inter-cylinder variation abnormality in the air/fuel ratio, and a detection method for the apparatus. Particularly, the invention relates to an apparatus able to detect that in a multi-cylinder internal combustion engine, the air/fuel ratio is varying among the cylinders to a relatively great extent, and a detection method for the apparatus.

2. Description of the Related Art

Generally, with regard to an internal combustion engine equipped with an exhaust control system that uses catalysts, in order to achieve high-efficient removal of pollutants from exhaust gas, it is essential to control the mixing rate between air and fuel in a mixture that is burned in the internal combustion engine, that is, control the air/fuel ratio. In order to perform the control of the air/fuel ratio, an air/fuel ratio sensor is provided in an exhaust passageway of the internal combustion engine, and a feedback control is performed so that the air/fuel ratio detected by the sensor becomes equal to a predetermined target air/fuel ratio.

Usually, in a multicylinder internal combustion engine, the air/fuel ratio control is performed by using the same control amount for all the cylinders; therefore, despite execution of the air/fuel ratio control, the actual air/fuel ratio sometimes varies among the cylinders. In such a case, if the variation in the air/fuel ratio is of a small degree, the variation in the air/fuel ratio can be absorbed by the feedback control of the air/fuel ratio and pollutants in exhaust gas can be removed by the catalysts. Thus, small degrees of the variation in the air/fuel ratio do not affect the exhaust emission, and do not cause any particular problem.

However, if the air/fuel ratio greatly varies among the cylinders due to, for example, failure of the fuel injection systems of one or more cylinders, etc., the exhaust emission deteriorates, and problems arise. It is desirable that such a large variation in the air/fuel ratio that deteriorates the exhaust emission be detected as an abnormality. Particularly, in the case of the internal combustion engines for use in motor vehicles, in order to prevent a vehicle from traveling with deteriorated exhaust emission, detection of inter-cylinder air/fuel ratio variation abnormality in a vehicle-mounted (on-bard) engine has been demanded, and is recently being made a legal requirement in some countries.

For example, an apparatus described in Japanese Patent Application Publication No. 2009-180171 (JP 2009-180171 A) detects abnormality in the variation in air/fuel ratio among the cylinders of an internal combustion engine on the basis of fluctuations of the air/fuel ratio of the engine. Furthermore, with regard to a plurality of fuel injection valves provided for each of the cylinders, the injection proportion among the plurality of fuel injection valves is altered, and it is discerned which of the fuel injection valves bears the cause of the variation abnormality on the basis of fluctuation of the air/fuel ratio between before and after the alteration in the injection proportion.

However, the construction described in Japanese Patent Application Publication No. 2009-180171 (JP 2009-180171 A) is able only to discern the presence or absence of the abnormality and which of the fuel injection valves has the abnormality, and is not able to specifically determine the degree of the abnormality.

SUMMARY OF THE INVENTION

Accordingly, in light of the foregoing circumstances, the invention provides an apparatus capable of specifically determining the degree of the abnormality in the variation in the air/fuel ratio among a plurality of fuel injection valves provided for each of a plurality of cylinders, in a construction in which it is discerned which of the fuel injection valves bears the cause of the variation abnormality, and also provides a method for the apparatus.

According to one aspect of the invention, there is provided an air/fuel ratio variation abnormality detection apparatus for an internal combustion engine that has a plurality of fuel injection valves for supplying fuel into each of a plurality of cylinders, the apparatus including: an abnormality detection device that detects an inter-cylinder variation abnormality in air/fuel ratio based on fluctuation of a predetermined output of the internal combustion engine; and an abnormal-place discernment device that, if the variation abnormality is detected by the abnormality detection device, discerns which of the fuel injection valves and an intake system bears a cause of the variation abnormality based on the fluctuation of the predetermined output between before and after injection proportion between the fuel injection valves is altered. The air/fuel ratio variation abnormality detection apparatus further includes an index value calculation device that, if it is discerned by the abnormal-place discernment device that the cause of the variation abnormality exists in a fuel injection valve of the plurality of fuel injection valves, calculates an index value that represents degree of the abnormality by normalizing the predetermined output regarding the fuel injection valve based on the injection proportion.

According to another aspect of the invention, there is provided an air/fuel ratio variation abnormality detection method for an internal combustion engine in which each of a plurality of cylinders has a plurality of fuel injection valves, as described below. In the method:

an inter-cylinder variation abnormality in air/fuel ratio is detected based on fluctuation of a predetermined output of the internal combustion engine;

if the variation abnormality is detected, it is discerned which of the fuel injection valves and an intake system bears a cause of the variation abnormality based on the fluctuation of the predetermined output between before and after injection proportion between the fuel injection valves is altered; and if it is discerned that the cause of the variation abnormality exists in a fuel injection valve of the plurality of fuel injection valves, an index value that represents degree of the abnormality is calculated by normalizing the predetermined output regarding the fuel injection valve based on the injection proportion.

In the air/fuel ratio variation abnormality detection apparatus and the air/fuel ratio variation abnormality detection method, if it is discerned that the cause of the variation abnormality exists in the intake system, an average value of predetermined outputs regarding all the fuel injection valves produced before and after the injection proportion is altered may be calculated as the index value regarding the intake system.

Besides, in the air/fuel ratio variation abnormality detection apparatus and method, the index value may be corrected by a correction factor that is based on engine rotation speed and intake air flow rate of the internal combustion engine. Herein, the correction factor may be a value that is smaller as the engine rotation speed is lower, and that is smaller as the intake air flow rate is higher.

Besides, in the air/fuel ratio variation abnormality detection apparatus and method, the index value may be updated by averaging or smoothing a latest calculated value of the index value and a past calculated value of the index value. Herein, the index value may be updated by a weighted averaging process of the latest calculated value and the past calculated value of the index value.

Besides, in the air/fuel ratio variation abnormality detection apparatus and method, if the index value calculated regarding a fuel injection valve is less than a predetermined value, the predetermined output may be acquired again by increasing the injection proportion of the fuel injection valve, and the index value may be calculated based on the predetermined output acquired.

According to the air/fuel ratio variation abnormality detection apparatus and the air/fuel ratio variation abnormality detection method of the invention as described above, there is achieved an excellent effect of becoming able to specifically determine the degree of the abnormality in the variation in the air/fuel ratio among a plurality of fuel injection valves provided for each of a plurality of cylinders, in a construction in which it is discerned which of the fuel injection valves bears the cause of the variation abnormality.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
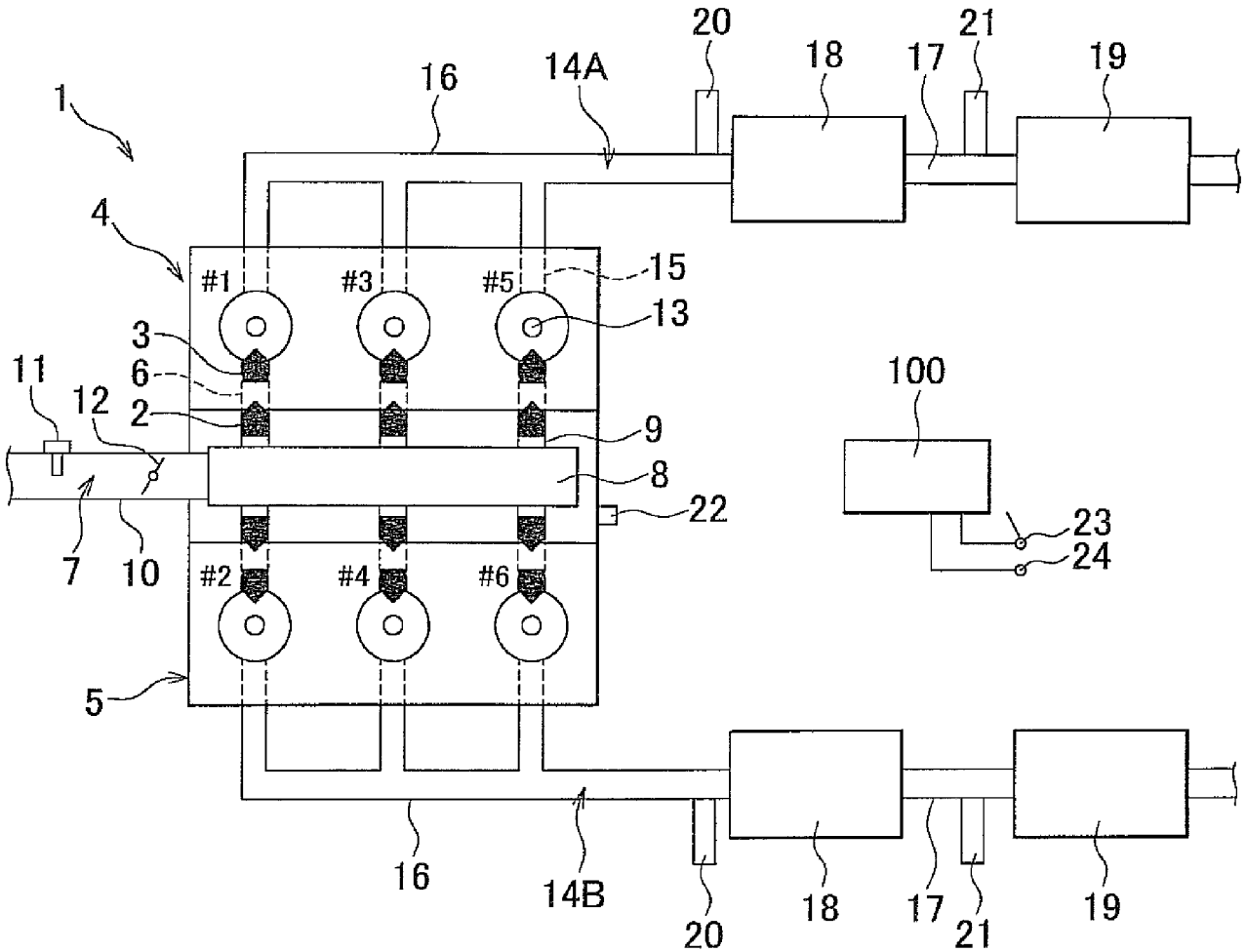
FIG. 1 is a schematic diagram of an internal combustion engine in accordance with an embodiment of the invention.

Hereinafter, embodiments of the invention will be described with reference to the accompanying drawings. FIG. 1 schematically shows an internal combustion engine in accordance with an embodiment. An internal combustion engine (engine) 1 shown in FIG. 1 is a V-type six-cylinder dual-injection gasoline engine. Each of cylinders #1 to #6 is provided with an intake passageway-injecting injector 2 and a cylinder-injecting injector 3. The engine 1 has a first bank 4 and a second bank 5. The first bank 4 is provided with odd-numbered cylinders, that is, #1, #3 and #5 cylinders, and the second bank 5 is provided with even-numbered cylinders, that is, #2, #4 and #6 cylinders.

Each intake passageway-injecting injector 2 injects fuel into an intake passageway of a corresponding one of the cylinders and, particularly, an intake port 6 thereof so as to realize so-called homogeneous combustion. Hereinafter, an intake passageway-injecting injector will be referred to also as "PFI". On the other hand, each cylinder-injecting injector 3 injects fuel directly into the combustion chamber of a corresponding one of the cylinders so as to realize so-called stratified combustion. Hereinafter, a cylinder-injecting injector will be referred to also as "DI".

An intake passageway 7 for introducing intake gas into the cylinders is formed by the intake ports, a surge tank 8 as an aggregated portion, a plurality of intake manifolds 9 that connect the intake ports 6 of the cylinders and the surge tank 8, an intake pipe 10 provided on an upstream side of the surge tank 8, etc. The intake pipe 10 is provided with an air flow meter 11 and an electronically controlled throttle valve 12 in that order from the upstream side. The air flow meter 11 outputs a signal whose magnitude is commensurate with the amount of intake gas flow. Each cylinder is provided with an ignition plug 13 for igniting a mixture in the cylinder.

In an exhaust passageway for discharging exhaust gas, in this embodiment, a first exhaust passageway 14A for the first bank 4 and a second exhaust passageway 14B for the second bank 5 are provided as separate systems. That is, two exhaust systems are provided independently for the two banks. Since the exhaust systems for the two banks are the same in construction, the following description will be made only about the first bank 4, and description of the exhaust system for the second bank 5 is omitted while it is shown in FIG. 1 with the same reference characters as used for the exhaust system for the first bank 4.

The first exhaust passageway 14A includes exhaust ports 15 of the #1, #3 and #5 cylinders, an exhaust manifold 16 that collects exhaust gases from the exhaust ports 15, and an exhaust pipe 17 connected to a downstream end of the exhaust manifold 16. In an upstream-side portion and a downstream-side portion of the exhaust pipe 17, there are provided an upstream catalyst 18 and a downstream catalyst 19, respectively, in series. Each of the catalysts 18 and 19 is made up of a three-way catalyst. At an upstream side and a downstream side of the upstream catalyst 18, there are disposed a pre-catalyst sensor 20 and a post-catalyst sensor 21, respectively, each of which is an air/fuel ratio sensor for detecting the air/fuel ratio of exhaust gas. These sensors detect the air/fuel ratio of exhaust gas on the basis of the oxygen concentration in exhaust gas. Thus, an aggregated portion of the exhaust passageways extending from each of the first and second banks is provided with one pre-catalyst sensor 20.

That is, the first exhaust passageway 14A for the first bank 4 and the second exhaust passageway 14B are each provided with a pre-catalyst sensor 20.

The PFIs 2, the DIs 3, the throttle valve 12, the ignition plugs 13, etc. are electrically connected to an electronic control unit (hereinafter, termed the ECU) 100 that serves as a control device. The ECU 100 includes a CPU, a ROM, a RAM, an input/output port, a storage device, etc. none of which is shown in the drawings. The ECU 100, as can be understood from FIG. 1, is electrically connected with the air flow meter 11, the pre-catalyst sensors 20 and the post-catalyst sensors 21, and also with a crank angle sensor 22 for detecting the crank angle of the engine 1, an accelerator operation amount sensor 23 for detecting the accelerator operation amount, a coolant temperature sensor 24 for detecting the temperature of an engine coolant, and other various sensors, via A/D converters or the like. On the basis of detected values or the like from the various sensors, the ECU 100 controls the PFIs 12, the DIs 13, the throttle valve 12, the ignition plugs 13, etc. to control the fuel injection amount, the fuel injection timing, the degree of throttle opening, the ignition timing, etc., so that a desired engine output is obtained. Besides, the ECU 10 detects the crank angle of the engine 1, and calculates the rotation speed of the engine 1, on the basis of the output of the crank angle sensor 22. As the rotation speed of the engine 1 herein, the number of revolutions per minute (rpm) is used.

Figure 2:
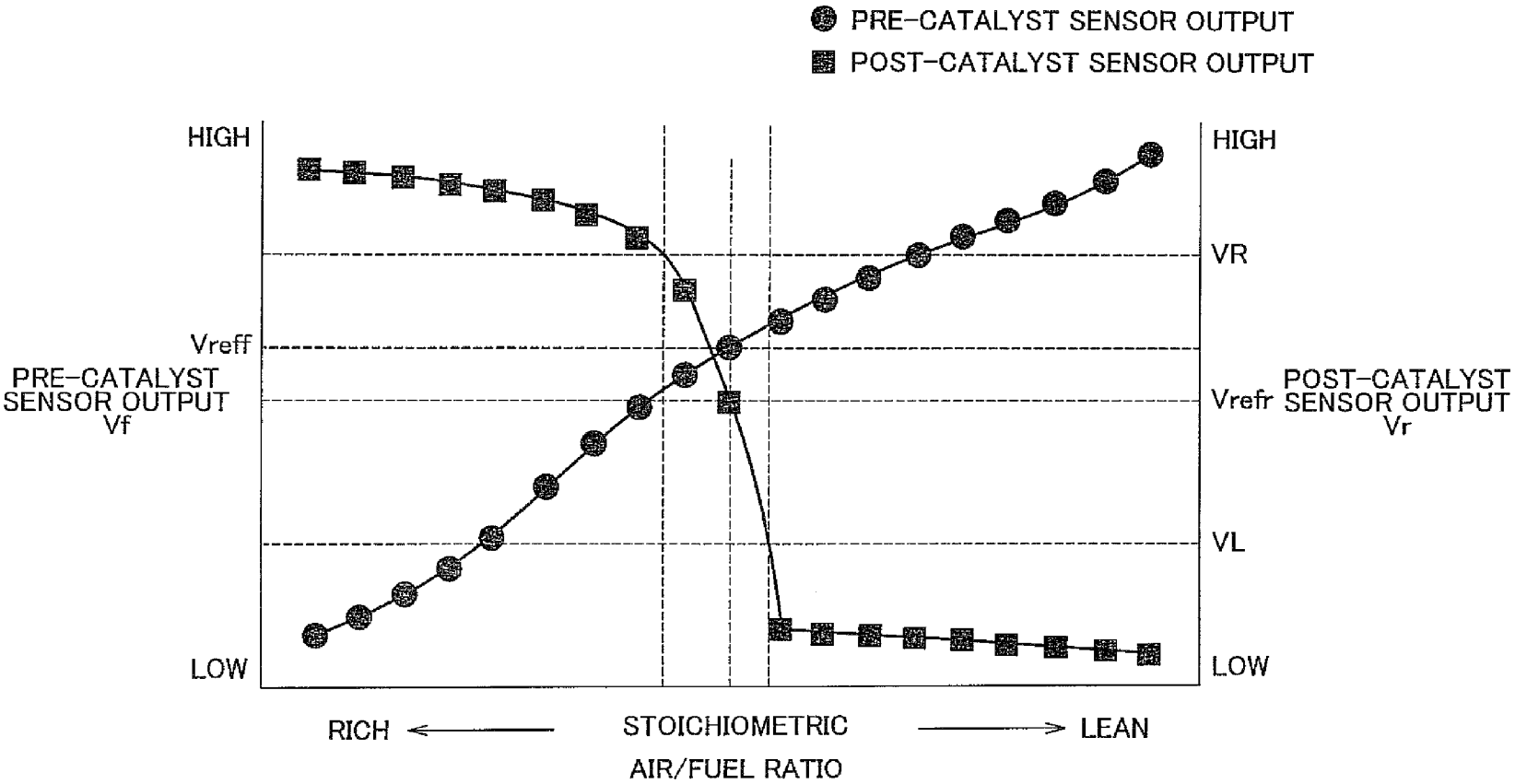
FIG. 2 is a graph showing output characteristics of a pre-catalyst sensor and a post-catalyst sensor in accordance with the embodiment.

The pre-catalyst sensor 20 of each system is made up of a so-called wide-range air/fuel ratio sensor, and is capable of continuously detect the air/fuel ratio over a relatively wide range. FIG. 2 shows an output characteristic of the pre-catalyst sensor 20. As shown in FIG. 2, the pre-catalyst 20 outputs a voltage signal Vf whose magnitude is proportional to the air/fuel ratio of exhaust gas. The output voltage that the pre-catalyst sensor 20 produces when the exhaust air/fuel ratio is stoichiometric (the stoichiometric air/fuel ratio, for example, A/F=14.6) is Vreff (e.g., about 3.3 V).

On the other hand, the post-catalyst sensor 21 is made up of a so-called O2 sensor, and has a characteristic in which the output value of the sensor changes sharply in the vicinity of the stoichiometric ratio. FIG. 2 also shows an output characteristic of the post-catalyst sensor 21. As shown in FIG. 2, the output voltage that the sensor 21 produces when the air/fuel ratio of exhaust gas is stoichiometric, that is, a stoichiometric ratio-corresponding voltage value, is Vrefr (e.g., 0.45 V). The output voltage of the post-catalyst sensor 21 changes within a predetermined range (e.g., of 0 to 1 (V)). When the exhaust air/fuel ratio is leaner than the stoichiometric ratio, the output voltage of the post-catalyst sensor is lower than the value Vrefr that corresponds to the stoichiometric ratio, and when the exhaust air/fuel ratio is richer than the stoichiometric ratio, the output voltage of the post-catalyst sensor is higher than the stoichiometric ratio-corresponding value Vrefr.

Each of the upstream catalyst 18 and the downstream catalyst 19 simultaneously removes NOx, HC and CO, which are pollutants in exhaust gas, when the air/fuel ratio A/F of the exhaust gas that flows into the catalyst is in the vicinity of the stoichiometric ratio. The range (window) of the air/fuel ratio in which the three pollutants can be simultaneously removed with high efficiency is relatively narrow.

An air/fuel ratio control (stoichiometric control) is executed by the ECU 100 so that the air/fuel ratio of the exhaust gas that flows into the upstream catalyst 18 is controlled to the vicinity of the stoichiometric ratio. This air/fuel ratio control includes such a main air/fuel ratio control (main air/fuel ratio feedback control) as to cause the exhaust air/fuel ratio detected by the pre-catalyst sensor 20 to be equal to the stoichiometric ratio, which is a predetermined target air/fuel ratio, and such a subsidiary air/fuel ratio control (subsidiary air/fuel ratio feedback control) as to cause the exhaust air/fuel ratio detected by the post-catalyst sensor 21 to be equal to the stoichiometric ratio.

The air/fuel ratio control as described above is performed separately for each bank. Specifically, the air/fuel ratio control of the #1, #3 and #5 cylinders that belong to the first bank 4 is performed on the basis of the outputs of the pre-catalyst sensor 20 and the post-catalyst sensor 21 on the first bank 4 side. On the other hand, the air/fuel ratio control of the #2, #4 and #6 cylinders that belong to the second bank 5 is performed on the basis of the outputs of the pre-catalyst sensor 20 and the post-catalyst sensor 21 on the second bank 5 side.

Besides, in the embodiment, a coordinated injection in which the total amount of fuel injected into a cylinder during one injection cycle is divided between the PFI 2 and the DI 3 according to predetermined injection proportions $\alpha$ and $\beta$ is performed. At this time, the ECU 100, according to the injection proportions $\alpha$ and $\beta$, sets an amount of fuel to be injected from the PFI 2 (termed the port injection amount) and an amount of fuel to be injected from the DI 3 (termed the cylinder injection amount), and controls the electrification of the injectors 2 and 3. The injection proportions $\alpha$ and $\beta$ herein are the percentages of the port injection amount and the cylinder injection amount, respectively, to the total amount of fuel injection, and have values that range between 0 and 100 ($\beta=100-\alpha$). If the total amount of fuel injection is represented by Qt, the port injection amount Qp is expressed as $\alpha\times Qt/100$, and the cylinder injection amount Qd is expressed as $\beta\times Qt/100$, and the injection proportion therebetween is $Qp:Qd=\alpha:\beta$. Thus, the injection proportions $\alpha$ and $\beta$ are values that prescribe the injection proportion between the PFI 2 and the DI 3, that is, the port injection amount Qp and the cylinder injection amount Qd. The total amount of fuel injection is set by the ECU 100 on the basis of the operation state of the engine (e.g., the engine rotation speed and load).

Figure 3:
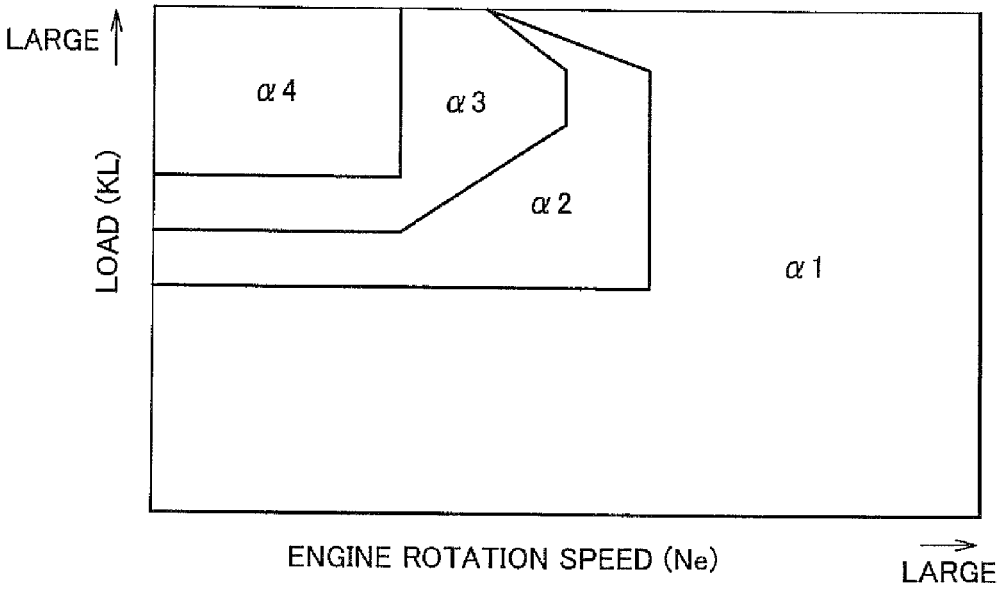
FIG. 3 shows a map for setting the proportion of the port injection amount to the total amount of fuel injection with regard to fuel injection valves in accordance with the embodiment.

FIG. 3 shows a map for setting the injection proportion $\alpha$. As shown in FIG. 3, the injection proportion a changes from $\alpha$1 to $\alpha$4 according to regions that are prescribed by the engine rotation speed Ne and the load KL. For example, $\alpha$1=0, $\alpha$1=35, $\alpha$3=50 and $\alpha$4=70. However, these values and the region dividing can be arbitrarily changed. In this example, the proportion of the port injection amount increases toward the low-rotation speed and high-load side. Besides, in the region of $\alpha=\alpha$1, the coordinated injection is not performed, but only the cylinder injection is performed to supply fuel. The same values of the injection proportions $\alpha$ and $\beta$ are used for all the cylinders of the two banks. That is, the injection proportions $\alpha$ and $\beta$ are not set separately for each bank.

It is assumed that, for example, one or more of the cylinders have injector failure, and variation (imbalance) in the air/fuel ratio among the cylinders has occurred. An example of this assumed situation is the case where the #1 cylinder has a large amount of fuel injection than the other cylinders, that is, the #2 to #6 cylinders, and the air/fuel ratio of the #1 cylinder deviates greatly to the rich side of the air/fuel ratio of the #2 to #6 cylinders. At this time, with regard to the first bank 2 that includes the #1 cylinder, if a relatively large correction amount is given by the aforementioned main air/fuel ratio feedback control, the air/fuel ratio of total gas can sometimes be controlled to the stoichiometric ratio. However, in such a case, if the cylinders are individually considered, it can be understood that the air/fuel ratio of the #1 cylinder is richer than the stoichiometric ratio and the air/fuel ratio of the #3 and #5 cylinders is leaner than the stoichiometric ratio, and the stoichiometric ratio is obtained merely as an overall balance among the cylinders, which is obviously not preferable in terms of emissions. Therefore, this embodiment is equipped with an apparatus that detects such an inter-cylinder air/fuel ratio variation abnormality.

Figure 4:
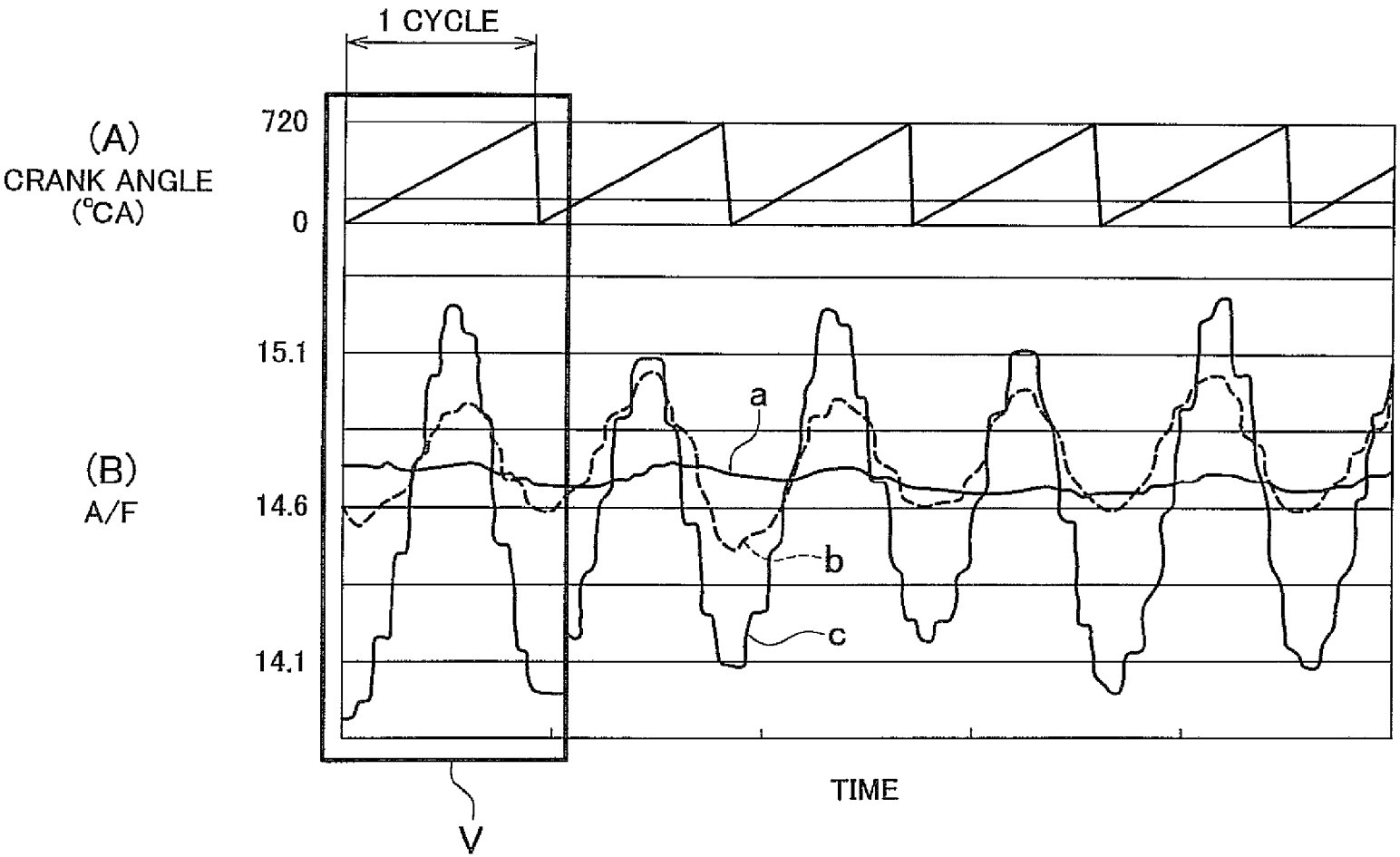
FIG. 4 is a time chart showing fluctuations of the air/fuel ratio sensor output in an in-line four-cylinder engine, which is different from a V-type six-cylinder engine used in the embodiment.

FIG. 4 shows fluctuations of the output of an air/fuel ratio sensor in an in-line four-cylinder engine, which is different from the engine in accordance with the embodiment. As shown in FIG. 4, the exhaust air/fuel ratio A/F detected by the air/fuel ratio sensor tends to cyclically fluctuate in a cycle of one engine cycle (=720° CA). If inter-cylinder air/fuel ratio variation occurs, the fluctuation in one engine cycle becomes large. Air/fuel ratio graphs a, b and c in a section (B) of FIG. 4 show the case where there is no such variation, the case where only in one cylinder, there is a rich deviation with an imbalance proportion of 20%, and the case where only in one cylinder, there is a rich deviation with an imbalance proportion of 50%, respectively. As can be seen in MG. 4, the greater the degree of variation, the larger the amplitude of fluctuations of the air/fuel ratio becomes. In a V-type six-cylinder engine as in the embodiment, there is a tendency similar to the above-described tendency, with regard to each one of the two banks.

Herein, the imbalance proportion (%) is a parameter that represents the degree of inter-cylinder air/fuel ratio variation. That is, the imbalance proportion is a value that shows, in the case where only one of all the cylinders has a deviated amount of fuel injection, by what proportion the amount of fuel injection of the cylinder that is having a deviation in the amount of fuel injection is deviated from the amount of fuel injection of the cylinders (balance cylinders) that have no deviation in the amount of fuel injection, that is, a reference amount of fuel injection. The imbalance proportion IB can be expressed as IB=(Qib−Qs)/Qs, where Q is the fuel injection amount of the imbalance cylinder, and Qs is the fuel injection amount of the balance cylinders, that is, the reference injection amount. The larger the imbalance proportion IB, the larger the fuel injection amount deviation of the imbalance cylinder to the balance cylinders is and the greater the degree of the air/fuel ratio variation is.

[Inter-Cylinder Air/Fuel Ratio Variation Abnormality Detection]

As can be understood from the foregoing description, if the air/fuel ratio variation abnormality occurs, the fluctuation of the output of the air/fuel ratio sensor enlarges. Therefore, it is possible to detect the variation abnormality on the basis of the output fluctuation.

It is to be noted herein that the variation abnormality falls into two types, that is, a rich deviation abnormality in which the fuel injection amount of a cylinder has deviated to the rich side (excess side), and a lean deviation abnormality in which the fuel injection amount of a cylinder has deviated to the lean side (insufficiency side). In this embodiment, the rich deviation abnormality is detected on the basis of fluctuation of the air/fuel ratio sensor output. However, the lean deviation abnormality may be detected, or variation abnormality may be generally detected without discriminating the rich deviation abnormality and the lean deviation abnormality.

At the time of detection of the rich deviation abnormality, an air/fuel ratio fluctuation parameter that is a parameter that correlates with the degree of fluctuation of the air/fuel ratio sensor output is calculated, and the air/fuel ratio fluctuation parameter is compared with a predetermined abnormality criterion value to detect abnormality. It is to be noted herein that the abnormality detection is performed separately for each bank by using the output of a corresponding air/fuel ratio sensor, that is, the output of a corresponding one of the pre-catalyst sensors 20.

Figure 5:
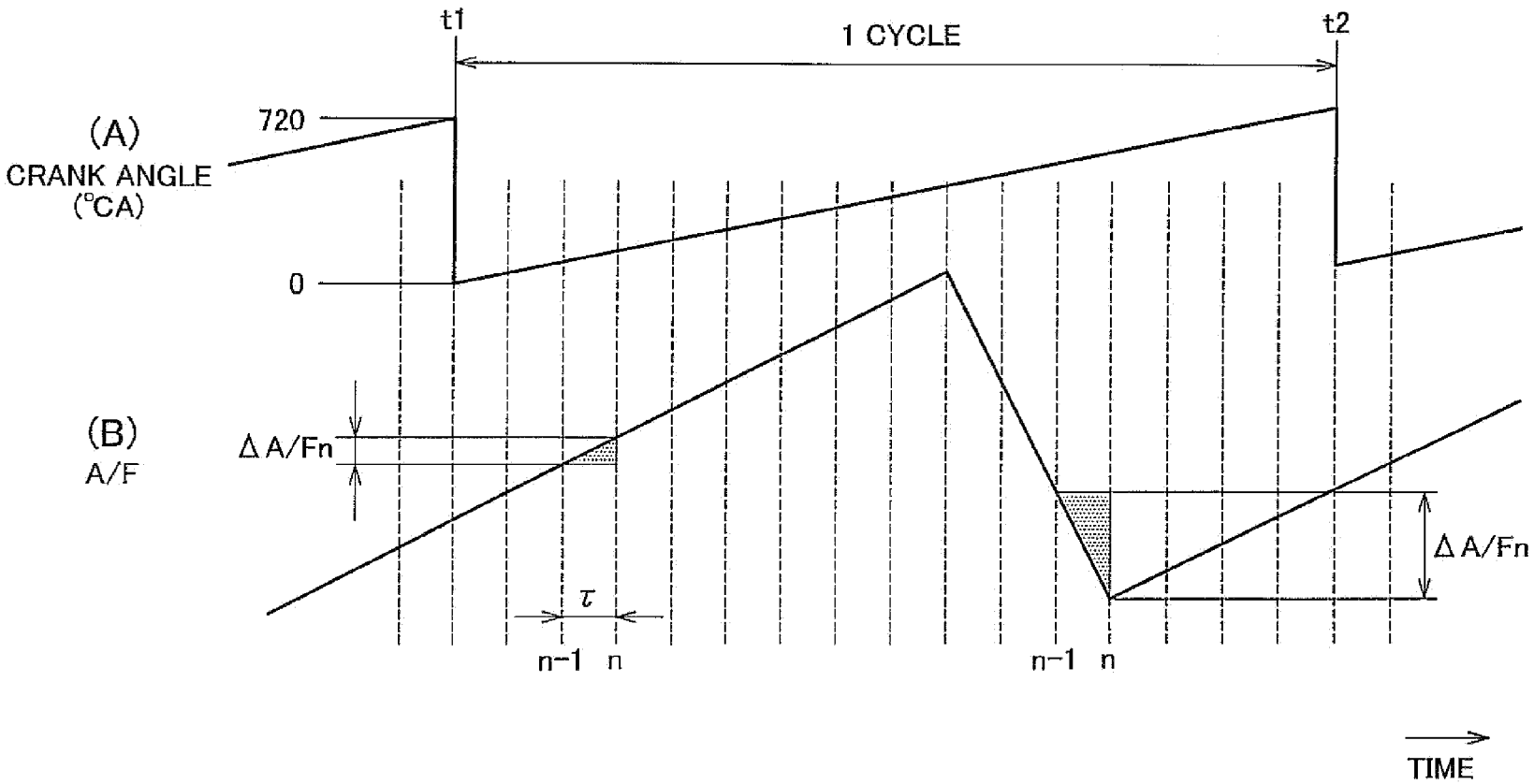
FIG. 5 is an enlarged view corresponding to a portion V shown in FIG. 4.

Hereinafter, a calculation method for the air/fuel ratio fluctuation parameter will be described. FIG. 5 is an enlarged diagram corresponding to a portion V in FIG. 4, and particularly shows fluctuations of the pre-catalyst sensor output within one engine cycle. The value of the pre-catalyst sensor output used herein is the value of air/fuel ratio A/F converted from the output voltage Vf of the pre-catalyst sensor 20. However, it is also possible to directly use the output voltage Vf of the pre-catalyst sensor 20.

As shown in a section (B) in FIG. 5, the ECU 100 acquires the value of the pre-catalyst sensor output every predetermined sample period τ (unit time, e.g., 4 ms) within one engine cycle. The absolute value of a difference ΔA/Fn between the value A/Fn acquired at the present timing (second timing) and the value A/Fn acquired at the previous timing (first timing) is found by the following expression (1). The difference ΔA/Fn can also be said to be a differential value or a slope at the present timing.

[MATHEMATICAL EXPRESSION 1]

$$\Delta A/F_n = A/F_n - A/F_{n-1} \quad (1)$$

In the simplest case, the difference ΔA/Fn represents the fluctuation of the pre-catalyst sensor output. This is because as the degree of fluctuation increases, the slope of the graph of the air/fuel ratio increases and the difference ΔA/Fn increases. Therefore, the value of the difference ΔA/Fn at a predetermined timing can be used as an air/fuel ratio fluctuation parameter.

However, in the embodiment, an average value of a plurality of differences ΔA/Fn is used as an air/fuel ratio fluctuation parameter in order to improve accuracy. In this embodiment, the average value of differences ΔA/Fn in one engine cycle is found by accumulating differences ΔA/Fn at individual timings within the one engine cycle and dividing a final accumulated value by the number N of samples. Then, such average values of differences ΔA/Fn are accumulated for M number of engine cycles (e.g., M=100), and the final accumulated value is divided by the number M of cycles to find an average value of differences ΔA/Fn in the M number of engine cycles. The thus-found final average value is defined as an air/fuel ratio fluctuation parameter, and is represented by "X" in the following description.

The air/fuel ratio fluctuation parameter X is greater as the degree of fluctuation of the pre-catalyst sensor output is greater. Then, if the air/fuel ratio fluctuation parameter X is greater than or equal to a predetermined abnormality criterion value, it is determined that the abnormality is present. If the air/fuel ratio fluctuation parameter X is less than the predetermined abnormality criterion value, it is determined that the abnormality is not present, that is, the present state is normal. Incidentally, using the cylinder distinction function of the ECU 100, it is possible to associate an ignition cylinder and its corresponding air/fuel ratio fluctuation parameter X.

Incidentally, since the pre-catalyst sensor output A/F increases in a case and decreases in another case, it is possible to find the aforementioned difference ΔA/Fn or an average value thereof in only one of the two cases, and to use it as a fluctuation parameter. In particular, in the case where only one cylinder has a rich deviation, the output of the pre-catalyst sensor rapidly changes to the rich side (i.e., sharply decreases) when the pre-catalyst sensor receives the exhaust gas that corresponds to the one cylinder; therefore, it is possible to use only the value on the decrease side for the detection of a rich deviation (rich imbalance determination). In this case, only a downward-sloping region of the A/F graph in the section (B) of FIG. 5 is used to detect the rich deviation. Generally, the switch from the lean to the rich side is often performed in a sharper manner than the switch from the rich to the lean side, the rich deviation can be expected to be accurately detected according to the foregoing method. However, this is not restrictive, and it is also possible to use only the value on the increase side, or use the values on both the decrease and increase sides (i.e., accumulate the absolute values of the differences ΔA/Fn, and compare the accumulated value with a threshold value).

Figure 6:
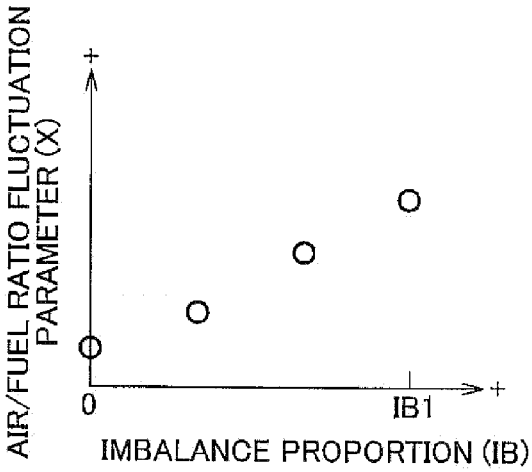
FIG. 6 is a graph showing a relation between the inter-cylinder air/fuel ratio imbalance proportion and an air/fuel ratio fluctuation parameter in the internal combustion engine in the embodiment.

FIG. 6 shows a relation between the imbalance proportion IB and the air/fuel ratio fluctuation parameter X. As shown in FIG. 6, there is a strong correlation between the imbalance proportion IB and the air/fuel ratio fluctuation parameter X, that is, the air/fuel ratio fluctuation parameter X increases as the imbalance proportion IB increases. In FIG. 6, IB1 is a value of the imbalance proportion IB that corresponds to a criterion that is a border value between normality and abnormality, and is, for example, 60(%).

Figure 7:
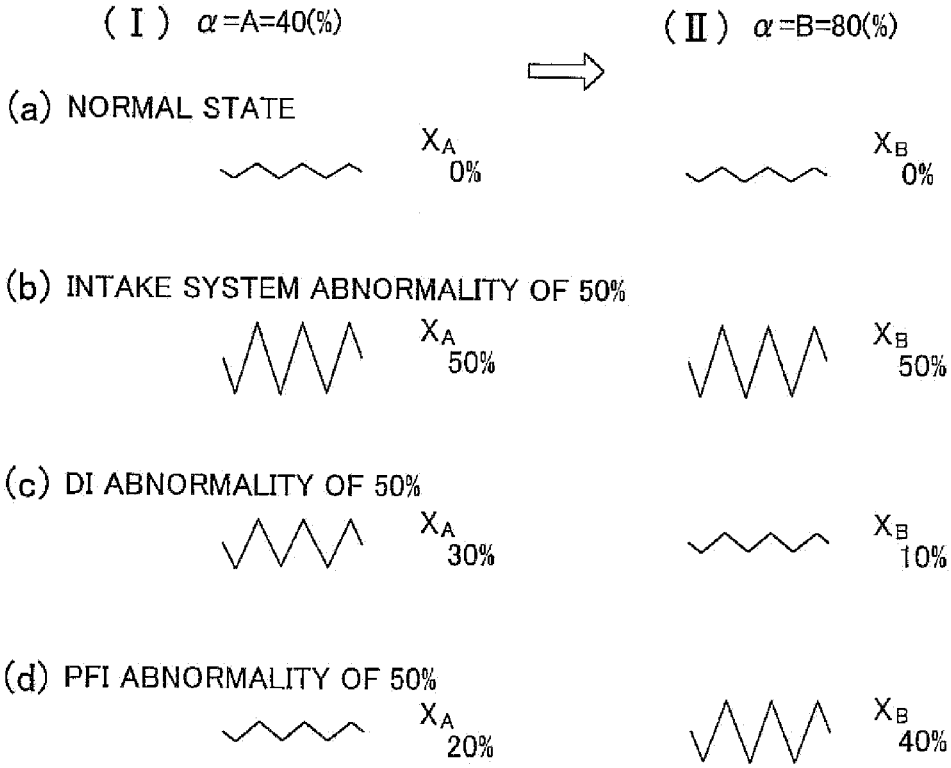
FIG. 7 is a diagram for illustrating the principle of a rich deviation abnormality detection regarding the amount of fuel injection in the internal combustion engine in the embodiment.

Hereinafter, the principle of the rich deviation abnormality detection in accordance with the embodiment will be described with reference to FIG. 7. In the embodiment, the air/fuel ratio deviation resulting from a failure in the intake system or the like, that is, an intake system abnormality, is also detected by using the air/fuel ratio fluctuation parameter X and altering the injection proportions α and β. A state I shown on the left side in FIG. 7 is the case where the injection proportion α of the PFI 2 is a reference value A=40%. Besides, a state II on the right side in FIG. 7 is the case where the injection proportion α is B=80%, which is greater than the reference value A. With the change from the state I to the state II, the injection proportion α changes from 40% to 80%, and the injection proportion of the DI 3 decreases from 60% to 20%, that is, the proportion of the port injection amount increases. Herein, the abnormality criterion value Z is tentatively determined as being a value that corresponds to an imbalance proportion of 20%. The waveforms shown in FIG. 7 are waveforms of the output of the pre-catalyst sensor 20 provided for one of the banks. That is, in this example, only one of the banks is considered. The detection with regard to the other bank may be performed at either the same timing or different timing.

A section (a) in FIG. 7 shows a normal state in which abnormality is not present with regard to the PFI 2 or the DI 3 of any one of the cylinders and abnormality is not present in the intake system either. In this case, during the state I, an air/fuel ratio fluctuation parameter $X_A$ that corresponds to 0% in the imbalance proportion is obtained, and during the state II, an air/fuel ratio fluctuation parameter $X_B$ corresponding to 0% in the imbalance proportion is obtained. That is, $X_A<Z$ and $Z_B<Z$. In this case, it is determined that the state is normal.

A section (b) in FIG. 7 shows a state of intake system abnormality of 50% in which neither the PFI 2 nor the DI 3 of any one of the cylinders has abnormality but the intake system has an abnormality that corresponds to 50% in the imbalance proportion. In this case, during the state I, an air/fuel ratio fluctuation parameter $X_A$ corresponding to 50% in the imbalance proportion is obtained, and during the state II, too, an air/fuel ratio fluctuation parameter $X_B$ corresponding to 50% in the imbalance proportion is obtained. If $X_A \geq Z$ and $X_B \geq Z$ and $|X_A - X_B| < Y$ (Y is a predetermined reference value), it is determined that the intake system abnormality is present. Incidentally, a reason why the value of the air/fuel ratio fluctuation parameter X remains unchanged between the state I and the state II is that since the PFIs 2 and the DIs 3 are all normal, the air/fuel ratio is not affected by change in the injection proportion α.

A section (c) in FIG. 7 shows a state of DI abnormality of 50% in which the DI 3 of one cylinder has an abnormality that corresponds to 50% in the imbalance proportion and the PFI 2 of the one cylinder and the PFIs 2 and the DIs 3 of the other cylinders are free from the abnormality and the intake system is also free from the abnormality. In this case, during the state I, an air/fuel ratio fluctuation parameter $X_A$ corresponding to 30% in the imbalance proportion is obtained. This is because since the injection proportion of the DIs 3 is (100−40)=60 (%), 50%×60%=30% results, that is, the influence of the abnormality of the DI 3 is reduced as a result of the coordinated injection. On the other hand, during the state II, an air/fuel ratio fluctuation parameter $X_B$ corresponding to 10% in the imbalance proportion is obtained. This is because since the injection proportion of the DIs 3 is (100−80)=20(%), 50%×20%=10% results. That is, $X_A \geq Z$ and $X_B<Z$. In this case, it is determined that the DI abnormality is present.

A section (d) in FIG. 7 shows a state of PFI abnormality of 50% in which the PFI 2 of one cylinder has an abnormality that corresponds to 50% in the imbalance proportion and the DI 3 of the one cylinder and the PFIs 2 and the DIs 3 of the other cylinders are free from the abnormality and the intake system is also free from the abnormality. In this case, during the state I, an air/fuel ratio fluctuation parameter $X_A$ corresponding to 20% in the imbalance proportion is obtained. This is because since the injection proportion of the PFIs 2 is 40%, 50%×40%=20% results, that is, the influence of the abnormality of the PEI 2 is reduced as a result of the coordinated injection. On the other hand, during the state II, an air/fuel ratio fluctuation parameter $X_B$ corresponding to 40% in the imbalance proportion is obtained. This is because since the injection proportion of the PFIs 2 is 80%, 50%×80%=40% results. That is, $X_A<Z$ and $X_B \geq Z$. In this case, it is determined that the PFI abnormality is present.

Figure 9:
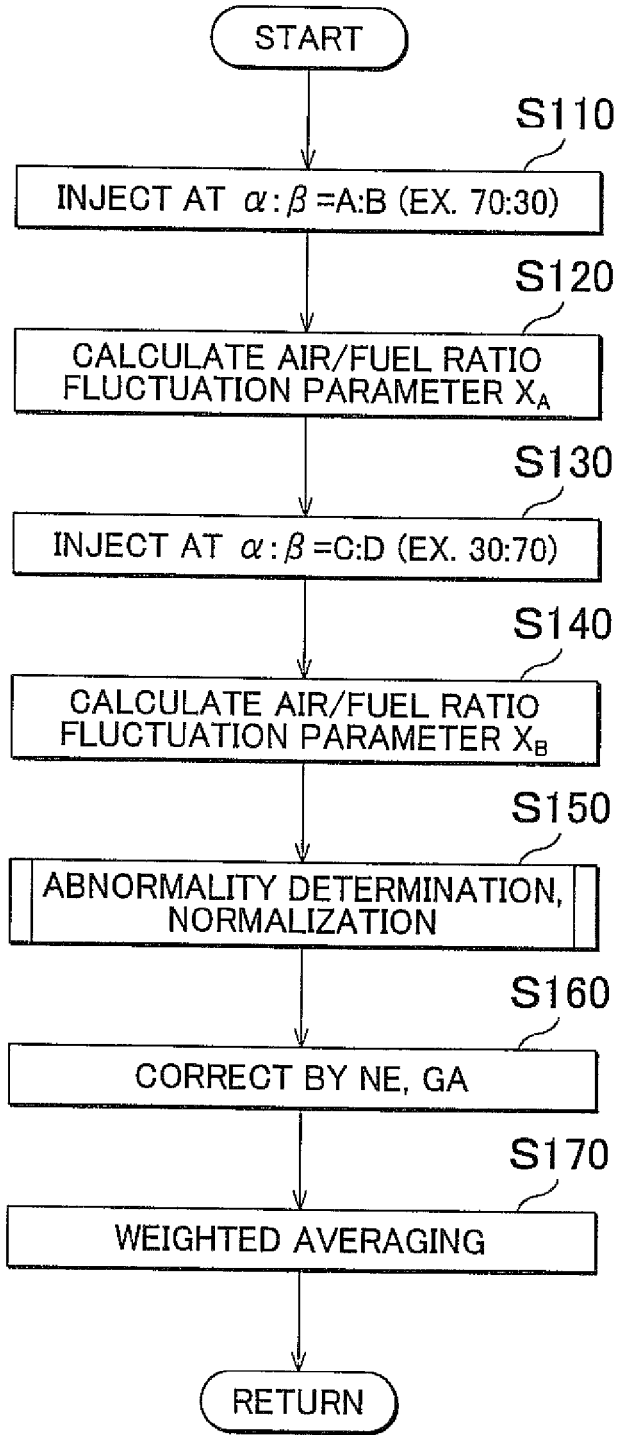
FIG. 9 is a flowchart showing a variation abnormality detection routine in the embodiment.

In accordance with the above-described principle, this embodiment detects the rich deviation abnormality and the intake system abnormality regarding each bank, and normalizes and corrects the air/fuel ratio fluctuation parameter, and performs the weighted averaging of the parameter. FIG. 9 shows an air/fuel ratio fluctuation parameter calculation process in the embodiment. This process is performed continually a plurality of times by the ECU 100 during one trip, at a predetermined timing, for example, by using the traveling distance of 1000 km as a trigger. By executing this process a plurality of times during one trip, the accuracy can be improved because the difference in the detection condition between the plurality of times of execution is small. Besides, this process is executed when the vehicle is steadily traveling or gently accelerating or decelerating at or above a predetermined engine rotation speed, that is, when the vehicle is in driving conditions except sharp acceleration and deceleration.

Firstly, the ECU 100 sets the injection proportions α and β to a first predetermined proportion A:B (e.g., 70:30), and accordingly causes the PFIs 2 and the DIs 3 to inject fuel (S110). Then, the ECU 100 calculates an air/fuel ratio fluctuation parameter $X_A$ on the basis of the output of the pre-catalyst sensor 20, which is an air/fuel ratio sensor (S120).

Next, the ECU 100 sets the injection proportions α and β to a second predetermined proportion C:D (e.g., 30:70), and accordingly causes the PFIs and the DIs 3 to inject fuel (S130). Then, the ECU 100 calculates an air/fuel ratio fluctuation parameter $X_B$ on the basis of the output of the pre-catalyst sensor 20, which is an air/fuel ratio sensor (S140).

After the air/fuel ratio fluctuation parameters $X_A$ and $X_B$ are calculated in this manner, the ECU 100, using the parameters, performs abnormality determination and normalization (S150).

Figure 10:
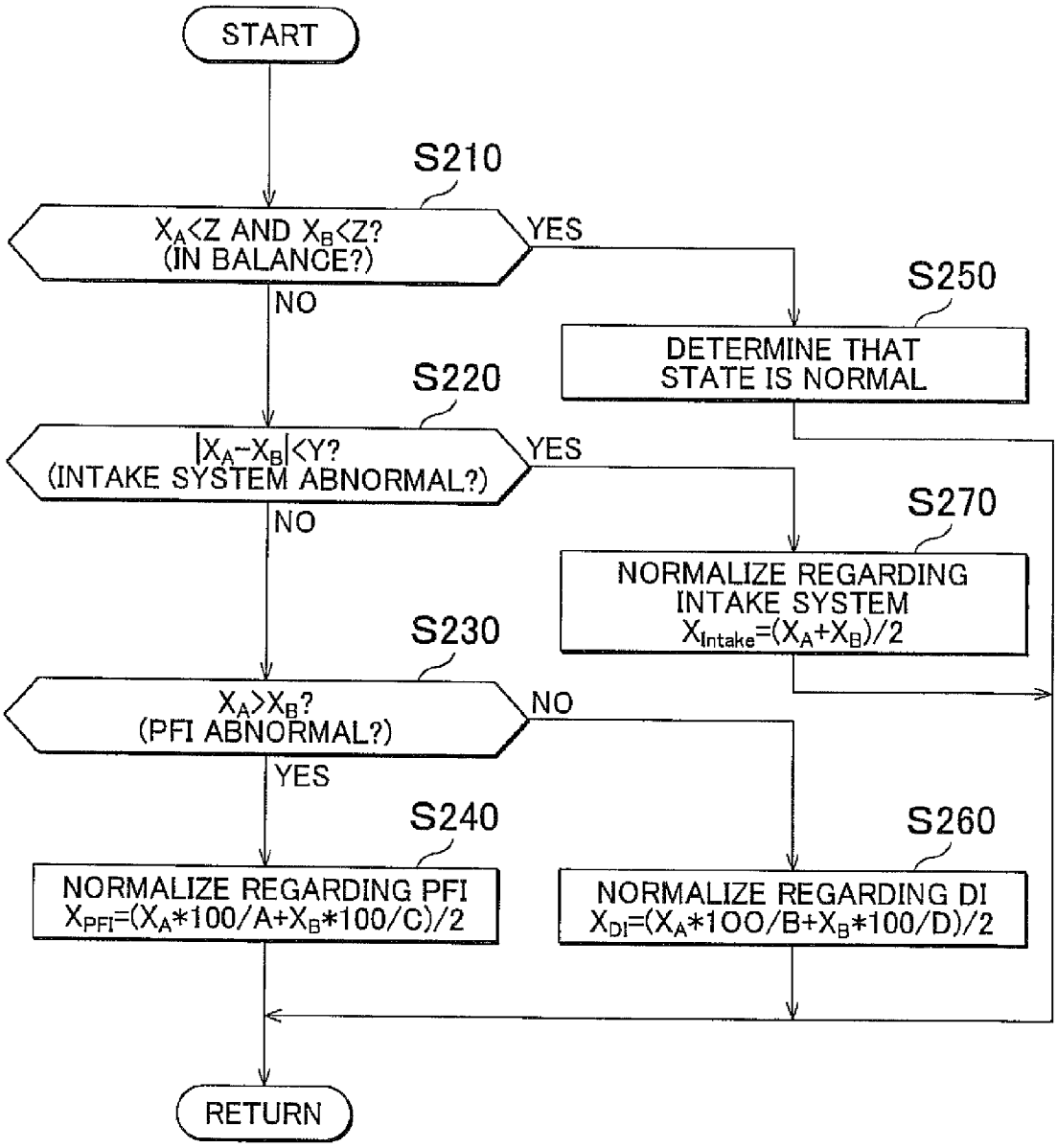
FIG. 10 is a flowchart showing a process of abnormality determination and normalization in the embodiment.

The processing procedure of the abnormality determination and the normalization is shown in FIG. 10. Referring to FIG. 10, the ECU 100 firstly compares the air/fuel ratio fluctuation parameters $X_A$ and $X_B$ with the aforementioned abnormality criterion value Z, and determines whether $X_A<Z$ and $X_B<Z$ (S210). This determination corresponds to the determination as to "whether there is any imbalance". If the determination is affirmative, it is determined that the state is normal (S250), and that information is recorded into a predetermined memory region, and then the routine is exited.

If a negative determination is made in step S210 (i.e., if there is imbalance among the PFIs 2 or the DIs 3 or in the intake system), the ECU 100 then compares the absolute value of a difference between the air/fuel ratio fluctuation parameters $X_A$ and $X_B$ with a second abnormality criterion value Y (S220). This determination corresponds to determination as to "whether the intake system is abnormal". If this determination is affirmative, a normalized air/fuel ratio fluctuation parameter $X_{intake}$ regarding the intake system is calculated by the following expression (2) (S270).

[MATHEMATICAL EXPRESSION 2]

$$X_{Intake}=(X_A+X_B)/2 \tag{2}$$

If the determination in step S220 is negative, that is, if the abnormality is present with regard to either the PFIs 2 or the DIs 3, it is determined whether the air/fuel ratio fluctuation parameter $X_A$ is greater than the air/fuel ratio fluctuation parameter $X_B$ (S230). If this determination is affirmative, that is, if the air/fuel ratio fluctuation parameter $X_A$ is greater than the parameter $X_B$, it is determined that the abnormality is present with regard to the PFIs 2, and a normalized air/fuel ratio fluctuation parameter $X_{PFI}$ regarding the PFIs 2 is calculated by the following expression (3) (S240).

[MATHEMATICAL EXPRESSION 3]

$$X_{PFI}=\left(X_A\times\frac{100}{A}+X_B\times\frac{100}{C}\right)/2 \tag{3}$$

If the determination in step S230 is negative, that is, if the air/fuel ratio fluctuation parameter $X_B$ is greater than or equal to the parameter $X_A$, it is determined that the abnormality is present with regard to the DIs 3, and a normalized air/fuel ratio fluctuation parameter $X_{DI}$ with regard to the DIs 3 is calculated by the following expression (4) (S260).

[MATHEMATICAL EXPRESSION 4]

$$X_{DI}=\left(X_A\times\frac{100}{B}\div X_B\times\frac{100}{D}\right)/2 \tag{4}$$

Figure 8:
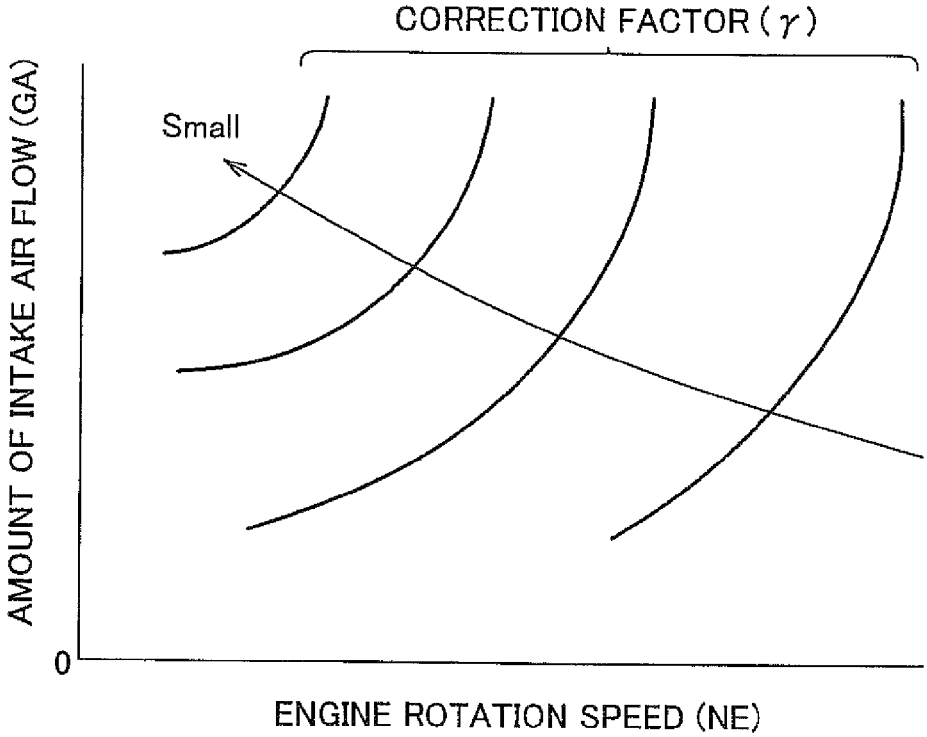
FIG. 8 is a graph for finding a correction factor γ for use for finding a normalized air/fuel ratio fluctuation parameter in the embodiment, that is, a graph showing an example of the setting of a correction factor map for use for finding the correction factor γ from the engine rotation speed NE and the amount of intake air flow GA.

Referring back to FIG. 9, the ECU 100 corrects the calculated air/fuel ratio fluctuation parameter $X_{PFI}$, $X_{DI}$ or $X_{Intake}$ by referring to a map based on the engine rotation speed NE and the intake air flow rate GA when the air/fuel ratio is detected (S160). Generally, the air/fuel ratio fluctuation parameters $X_A$ and $X_B$ are larger as the engine rotation speed is lower and the intake air flow rate is larger. Therefore, in the map, a correction factor ° C. that is smaller as the engine rotation speed is lower and the intake air flow rate is larger as shown in FIG. 8 is set so as to cancel out the influence of the engine rotation speed NE and the intake air flow rate GA. Therefore, as a result of the process in step S160, the influence of the engine rotation speed NE and the intake air flow rate GA is excluded from the normalized air/fuel ratio fluctuation parameter $X_{PFI}$, $X_{DI}$ or $X_{Intake}$.

Next, the ECU 100 reflects the latest value of the normalized and corrected air/fuel ratio fluctuation parameter $X_{PFI}$, $X_{DI}$ or $X_{Intake}$ on the average value $X_{PFIave}$, $X_{DIave}$ or $X_{Intakeave}$ up to the immediately previous execution of the process which is stored in the memory, by a weighted averaging process (S170). This process is carried out by the following expression (5). In the expression, $X_{PFInew}$ is the latest value, and $X_{PFIave}$ is the average value up to the immediately previous execution of the process. Incidentally, the weighted averaging process with regard to the air/fuel ratio fluctuation parameter $X_{DI}$ or $X_{Intake}$ regarding the DIs 3 or the intake system is also performed by similar mathematical expressions.

[MATHEMATICAL EXPRESSION 5]

$$X_{PFIave}=0.1\times X_{PFInew}+0.9\times X_{PFIave} \tag{5}$$

The average value $X_{PFIave}$, $X_{DIave}$ or $X_{Intakeave}$ of the air/fuel ratio fluctuation parameter obtained by the above-described process is stored into the memory.

Incidentally, in various controls which are constructed so as to cancel out the imbalance and in which the control amount is variable, the average value $X_{PFIave}$, $X_{DIave}$ or $X_{Intakeave}$ of the air/fuel ratio fluctuation parameter can be used to determine the control amount. Such controls include alteration of the fuel injection timing (e.g., the fuel injection timing of a cylinder whose air/fuel ratio is rich is set during the exhaust stroke, and the fuel injection timing of a cylinder whose air/fuel ratio is lean is set during the intake stroke), and alteration of the ignition timing (e.g., the ignition timing of a cylinder whose air/fuel ratio is rich is retarded, and the ignition timing of a cylinder whose air/fuel ratio is lean is advanced).

Besides, in order to cancel out the imbalance, it is conceivable to perform a control of correcting the operation of the fuel injection valves (the PFIs 2 and the DIs 3) or the intake valves in such a direction as to cancel out a corresponding cause of abnormality, including the increasing (decreasing) of fuel injection duration, the increasing (decreasing) of the effective opening areas in the case of variable nozzle hole type injection valves, the increasing (decreasing) of the opening degree of the intake valves in the case of a lean deviation caused by an intake system abnormality, or the increasing (decreasing) of the open valve duration of the intake valves. The average value $X_{PFIave}$, $X_{DIave}$ or $X_{Intakeave}$ of the air/fuel ratio fluctuation parameter can be reflected on the correction amount of such a control. For example, it is preferable to increase the control amount as the degree of abnormality is greater.

Besides, as for a fuel injection valve determined as being abnormal, it is also permissible to prohibit the use of the injection valve and to continue the operation of the engine by using only the other one of the injector valves (or the other ones of them if three or more injector valves are provided). In the case where the degree of abnormality (i.e., the average value $X_{PFIave}$, $X_{DIave}$ or $X_{Intakeave}$ of the air/fuel ratio fluctuation parameter) is low to such a degree that the immediate repair or replacement is not needed, it is permissible to predict the time when the member concerned needs to be repaired or replaced and store the predicted time into a predetermined diagnosis memory, or to produce an output, for example, turn on a warning lamp in a cabin of the vehicle.

As described above, in this embodiment, in a construction in which each of a plurality of cylinders is provided with a plurality of fuel injection valves, if it is discerned that the cause of the inter-cylinder variation abnormality exists in one of the fuel injection valves, the air/fuel ratio fluctuation parameters $X_A$ and $X_B$ regarding the fuel injection valves are normalized on the basis of the injection proportions A, B, C and D used at the time of measurement so as to calculate an air/fuel ratio fluctuation parameter $X_{PFI}$, $X_{DI}$ or $X_{Intake}$ as an index value that represents the degree of abnormality. Therefore, it is possible to specifically determine the degree of imbalance while cancelling out or restraining the influence of the injection proportion, thus making it possible to execute other processes commensurate with the degree of imbalance, for example, execute various controls for cancelling out the imbalance.

Besides, if it is discerned that the cause of the variation abnormality exists in the intake system, the apparatus of this embodiment calculates as an index value regarding the intake system (normalized air/fuel ratio fluctuation parameter $X_{intake}$ an average of the air/fuel ratio fluctuation parameters $X_A$ and $X_B$ (S270 and Expression (2)) regarding all the fuel injection valves (the PFIs 2 and the DIS 3) before and after the alteration of the injection proportion. Therefore, with regard to the intake system, too, the degree of imbalance can be appropriately specifically determined.

Besides, in this embodiment, the index value is updated by averaging and smoothing the latest calculated value of the index value and the past calculated value thereof (S170 and Expression (5)). Therefore, by stabilizing the index value, the processes, such as controls and the like, which use the index value can be stabilized. Incidentally, although in the embodiment, the weighted averaging process with a ratio of 1:9 is performed, the ratio may be a ratio other than 1:9, for example, it may be 1:1. Besides, it is also permissible to perform an averaging process (that is a process of averaging sequential data, and that includes arithmetic average and weighted average) or a smoothing process (that is a process of smoothing sequential data, and that includes simple moving average and weighted moving average) with regard to the latest and past values.

Incidentally, although in this embodiment, the normalization of the PFIs 2 and the DIs 3 is performed by the expressions (3) and (4), the normalization thereof may also be performed by using only the air/fuel ratio fluctuation parameter detected values ($X_A$ or $X_B$) that is obtained when the injection proportion of the fuel injection valve that has been determined as being abnormal is high, as in the following expressions (6) and (7).

[MATHEMATICAL EXPRESSION 6]

$$X_{PFI} = X_A \times \frac{100}{A} \tag{6}$$

[MATHEMATICAL EXPRESSION 7]

$$X_{DI} = X_B \times \frac{100}{D} \tag{7}$$

Next, a second embodiment of the invention will be described. In the second embodiment, when an index value calculated for a fuel injection valve (normalized air/fuel ratio fluctuation parameter $X_{PFI}$ or $X_{DI}$) is smaller than a predetermined value, the injection proportion of that fuel injection valve (the PFI 2 or the DI 3) is increased to acquire a predetermined output (air/fuel ratio fluctuation parameter $X_C$) again, and then the index value (normalized air/fuel ratio fluctuation parameter $X_{PFI}$ or $X_{DI}$) is calculated again on the basis of the acquired predetermined output. The mechanical construction of the second embodiment is substantially the same as that of the first embodiment.

Figure 11:
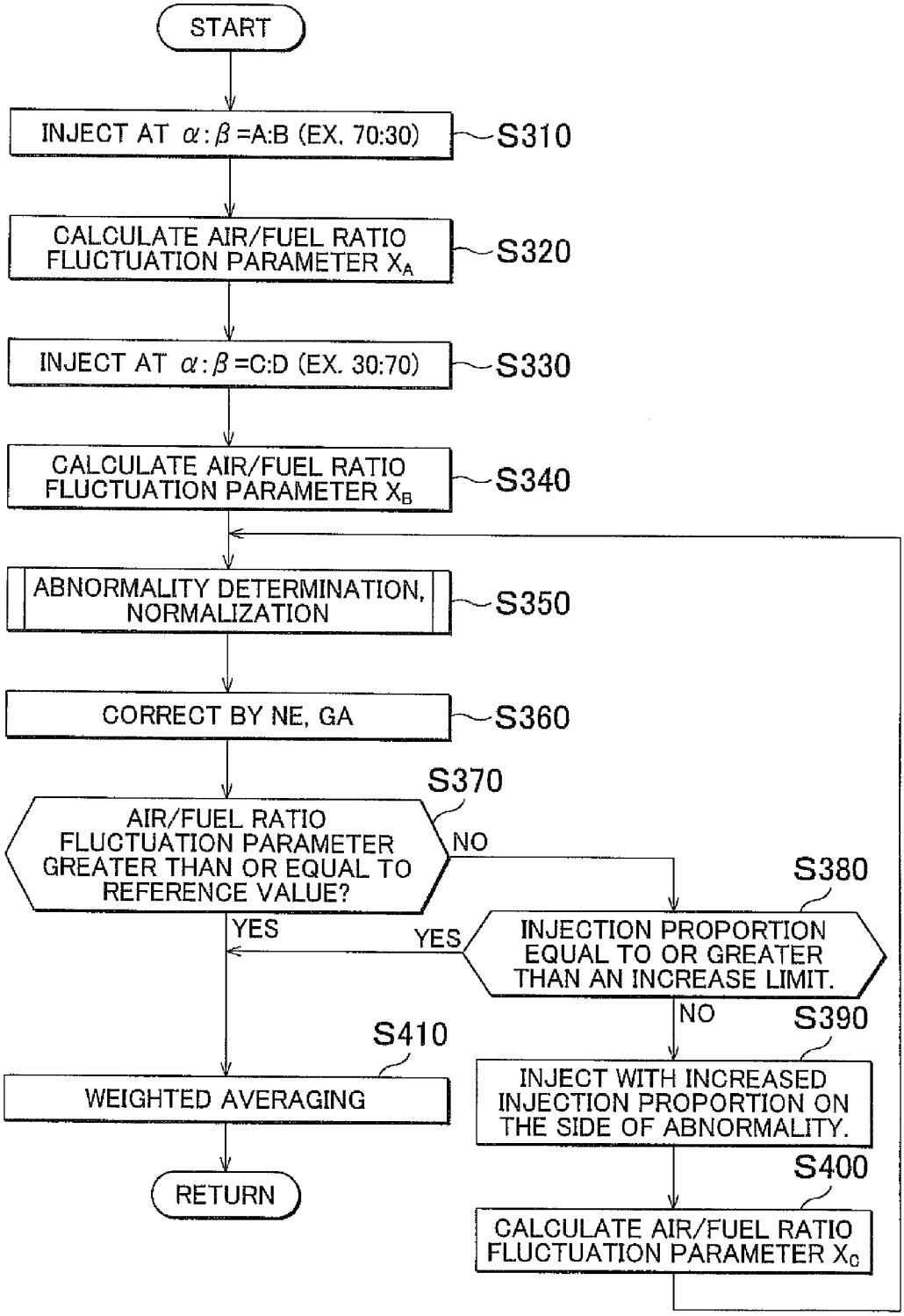
FIG. 11 is a flowchart showing a variation abnormality detection routine in a second embodiment of the invention.

A process that is executed in the second embodiment will be described with reference to FIG. 11. In FIG. 11, a process of steps S310 to S360 is substantially the same as the process of steps S110 to S160 in the first embodiment. In 5370, the ECU 100 determines whether the air/fuel ratio fluctuation parameter $X_{PFI}$, $X_{DI}$ or $X_{Intake}$ corrected by the engine rotation speed NE and the intake air flow rate GA is greater than or equal to a predetermined reference value. If the determination is affirmative, weighted averaging similar to that in step S170 is performed (S410). After that, the process is returned.

If the determination is negative, that is, if the air/fuel ratio fluctuation parameter $X_{PFI}$, $X_{DI}$ or $X_{Intake}$ is less than the reference value, it is then determined whether the injection proportion of the fuel injection valve (the PFI 2 or the DI 3) determined as being abnormal is an increase limit (e.g., 100%) (S380). If this determination is affirmative, the process proceeds to step S410. If the determination is negative, the ECU 100 increases the injection proportion of the fuel injection valve determined as being abnormal by a predetermined proportion (e.g., 10%) and causes the fuel injection valve to accordingly execute injection (S390). In that state, the ECU 100 calculates the air/fuel ratio fluctuation parameter $X_C$ (S400).

The calculated air/fuel ratio fluctuation parameter $X_C$ is used again for the abnormality determination and the normalization (S350). It is to be noted herein that in the process of the abnormality determination and the normalization (S350), of the air/fuel ratio fluctuation parameters $X_A$ and $X_B$ handled in the process routine shown in FIG. 10, the parameter in which the injection proportion of the fuel injection valve determined as being abnormal is the higher is substituted with the air/fuel ratio fluctuation parameter $X_C$.

As a result of the above-described process in the embodiment, when the index value calculated for a fuel injection valve (normalized air/fuel ratio fluctuation parameter $X_{PFI}$ or $X_{DI}$) is smaller than a predetermined value, the injection proportion of that fuel injection valve (the PFI 2 or the DI 3) is increased to acquire a predetermined output (air/fuel ratio fluctuation parameter $X_C$) again, and then the index value (normalized air/fuel ratio fluctuation parameter $X_{PFI}$ or $X_{DI}$) is calculated again on the basis of the acquired predetermined output. Therefore, according to the second embodiment, the degree of the variation abnormality can be more accurately detected.

While the preferred embodiments of the invention have been described in detail above, various other embodiments of the invention are conceivable. For example, although in the foregoing embodiments, the inter-cylinder air/fuel ratio variation abnormality is detected on the basis of fluctuation of the air/fuel ratio, the detection may also be performed on the basis of fluctuation in rotation of the internal combustion engine. In that case, for example, the proportion of the time that it takes for the crankshaft to rotate 30° CA in the vicinity of the TDC of a cylinder to the comparable time for other cylinders can be used as an air/fuel ratio fluctuation parameter. Any value that correlates with the degree of fluctuation of the pre-catalyst sensor output can be used as an air/fuel ratio fluctuation parameter. For example, an air/fuel ratio fluctuation parameter can be calculated on the basis of a difference between the maximum value and the minimum value of the pre-catalyst sensor output within one engine cycle (so-called peak-to-peak difference). This is because the difference is larger as the degree of fluctuation of the pre-catalyst sensor output is larger. The air/fuel ratio variation abnormality may be detected on the basis of the air/fuel ratio feedback correction amount.

Besides, there is no particular limitation on the number of cylinders of the engine, the type of the engine, the uses thereof, etc. It may be also appropriate that the number of fuel injection valves be an arbitrary number equal to or greater than Besides, the fuel injection valves may be provided in either the intake ports or the cylinders, that is, all the fuel injection valves may also be provided in the intake ports, or all the fuel injection valves may also be provided in the cylinders. In the case of a spark ignition type internal combustion engine such as a gasoline engine, it is possible to use an alternative fuel (alcohol, a gaseous fuel such as CNG or the like, etc.).

Embodiments of the invention are not limited to the foregoing embodiments, and the invention includes all modifications, applications and equivalents encompassed within the idea of the invention defined in the claims. Therefore, the invention should be interpreted in a limited manner, but can be applied to other arbitrary technology that belongs to the range of the idea of the invention.

While the invention has been described with reference to example embodiments thereof, it is to be understood that the invention is not limited to the described example embodiments or constructions. To the contrary, the invention is intended to cover various modifications and equivalent arrangements, In addition, while the various elements of the example embodiments are shown in various combinations and configurations, other combinations and configurations, including more, less or only a single element, are also within the scope of the invention.

What is claimed is:

1. An air/fuel ratio variation abnormality detection apparatus for an internal combustion engine in which each of a plurality of cylinders has a plurality of fuel injection valves, comprising:

an abnormality detection device that detects an inter-cylinder variation abnormality in an air/fuel ratio based on a fluctuation of a predetermined output of the internal combustion engine;

an abnormal-place discernment device that, if the variation abnormality is detected, discerns which of the fuel injection valves and an intake path to the cylinders bears a cause of the variation abnormality based on the fluctuation of the predetermined output between before and after injection proportion between the plurality of fuel injection valves is altered; and an index value calculation device that, if it is discerned that the cause of the variation abnormality exists in one of the fuel injection valves, calculates an index value that represents a degree of the abnormality by normalizing the predetermined output regarding the fuel injection valve based on the injection proportion.

2. The air/fuel ratio variation abnormality detection apparatus according to claim 1, wherein the index value calculation device calculates as the index value regarding the intake path, an average value of predetermined outputs regarding all the plurality of fuel injection valves produced before and after the injection proportion is altered, if it is discerned that the cause of the variation abnormality exists in the intake path.

3. The air/fuel ratio variation abnormality detection apparatus according to claim 1, wherein the index value calculation device updates the index value by averaging or smoothing a latest calculated value of the index value and a past calculated value of the index value.

4. The air/fuel ratio variation abnormality detection apparatus according to claim 1, wherein the index value calculation device, if the index value calculated regarding a fuel injection valve is less than a predetermined value, acquires the predetermined output again by increasing the injection proportion of the fuel injection valve, and calculates the index value based on the acquired predetermined output.

* * * * *